US005423259A

United States Patent [19]

Su

[11] Patent Number: 5,423,259

[45] Date of Patent: Jun. 13, 1995

[54] APPARATUS FOR ERASING A PLATE CYLINDER OF AN OFFSET PRINTING PRESS

[76] Inventor: Wu-Shuan Su, No. 79, Chiao-Cheng Rd., Ta-Li City, Taichung Hsien, Taiwan, Prov. of China

[21] Appl. No.: 302,970

[22] Filed: Sep. 12, 1994

[51] Int. Cl.[6] ..... B41F 35/02

[52] U.S. Cl. ..... 101/423; 101/425

[58] Field of Search ..... 101/423, 425, 154, 155, 101/157, 161, 167, 169; 15/256.5, 256.51, 256.53

[56] References Cited

U.S. PATENT DOCUMENTS

| | | | |
|---|---|---|---|
| 3,898,929 | 8/1975 | Arild et al. | 101/425 |
| 4,082,038 | 4/1978 | Ueno et al. | 101/425 |
| 4,899,654 | 2/1990 | Hoshi et al. | 101/167 |
| 4,919,756 | 4/1990 | Sawdai | 101/425 |
| 5,070,783 | 12/1991 | Ireton | 101/157 |
| 5,152,220 | 10/1992 | Lindner et al. | 101/167 |
| 5,167,189 | 12/1992 | Jones | 101/423 |

*Primary Examiner*—Ren Yan

*Attorney, Agent, or Firm*—Joseph W. Berenato, III

[57] ABSTRACT

An apparatus for erasing a plate cylinder of an offset printing press includes a first guide unit which is mounted to the offset printing press apart from the plate cylinder and which extends in an axial direction of the plate cylinder. A mounting unit includes at least two spaced mounting members mounted on the first guide unit, an elongated base plate spanning and fixed to the mounting members, and a sliding-plate assembly mounted longitudinally and movably on a top surface of the base plate for holding an erasing member which is used for erasing impurities on the plate cylinder. A pair of second guide units are mounted respectively and securely to two opposite transverse ends of the elongated base plate for guiding movement of the sliding-plate assembly on the elongated base plate in a direction toward the plate cylinder. A pair of driving units are mounted respectively on the second guide units for moving the sliding-plate assembly relative to the elongated base plate so as to push the erasing member against the plate cylinder.

11 Claims, 9 Drawing Sheets

APPARATUS FOR ERASING A PLATE CYLINDER OF AN OFFSET PRINTING PRESS

BACKGROUND OF THE INVENTION

1. Field of the invention

This invention relates to an apparatus for erasing a plate cylinder of an offset printing press, more particularly to an apparatus which has a pair of driving units for moving an erasing member of the apparatus toward the plate cylinder to erase a printing plate of the plate cylinder.

2. Description of the Related Art

This invention is an improvement of a conventional apparatus for erasing a plate cylinder (B) of an offset printing press, as shown in FIG. 1. The offset printing press further includes an inking roller (D) and a moistening roller (C) which are mounted therewithin adjacent to the plate cylinder (B) and which are spaced apart from each other at a predetermined distance. The plate cylinder (B) carries a printing plate.

The conventional apparatus, as shown in FIGS. 1 and 2, includes an elongated guide plate (X) which is mounted to the offset printing press apart from the plate cylinder (B) and which extends in an axial direction of the plate cylinder (B) (see FIG. 1), a mounting unit (Q) which is mounted slidably on the elongated guide plate (X), and an elongated erasing member (Q1) which is mounted to the mounting unit (Q) and which extends from the mounting unit (Q) through the space between the inking and moistening rollers (D, C) to a position near the plate cylinder (B) in order to erase impurities on the printing plate of the plate cylinder (B) when the erasing member (Q1) is depressed manually against the printing plate of the plate cylinder (B). The operating steps of the conventional apparatus are follows:

Initially, a sensor (not shown) of the conventional apparatus, which is mounted on the offset printing press, detects the presence of impurities on the printing plate of the plate cylinder (B).

Then, the mounting unit (Q) of the conventional apparatus is moved manually along the guide plate (X) to align the erasing member (Q1) with the detected impurities and in accordance with scale members (Y) (see FIG. 2) which are formed on the outer surface of the offset printing press above the guide plate (X).

Finally, when the mounting unit (Q) is moved to a desired position, the erasing member (Q1) is depressed manually against the printing plate of the plate cylinder (B) so as to erase the impurities on the printing plate.

From the above described operating steps of the conventional apparatus for erasing the plate cylinder (B) of the offset printing press, we can easily discover several drawbacks. For example, the complicated operating steps involved may affect the working efficiency of the offset printing press. Next, it is quite dangerous for an operator to depress manually the erasing member (Q1) of the conventional apparatus against the printing plate of the plate cylinder (B) when the offset printing press is being actuated. In addition, the erasing member (Q1) of the conventional apparatus, when depressed manually against the printing plate of the plate cylinder (B), may result in damage to the printing plate of the plate cylinder (B) due to the application of excess depressive forces by the erasing member (Q1) on the printing plate.

SUMMARY OF THE INVENTION

Therefore, the main objective of this present invention is to provide an apparatus which has a pair of driving units for moving an erasing member of the apparatus toward the plate cylinder of an offset printing press for erasing a printing plate of the plate cylinder.

Another objective of this present invention is to provide an apparatus which can erase the whole printing plate of the plate cylinder of the offset printing press at one time without the needs for using the sensor and the scale members of the conventional apparatus.

According to this invention, an apparatus, which is used for erasing a plate cylinder of an offset printing press, includes a first guide unit, a mounting unit, an erasing member, a pair of second guide units and a pair of driving units. The plate cylinder of the offset printing press carries a printing plate.

The first guide unit is mounted securely on the offset printing press apart from the plate cylinder and extends in an axial direction of the plate cylinder.

The mounting unit includes at least two spaced mounting members mounted on the first guide unit, an elongated base plate which spans and which is fixed to the mounting members, and a sliding-plate assembly mounted longitudinally and movably on a top surface of the elongated base plate for holding the erasing member which is used to erase impurities on the printing plate of the plate cylinder.

The second guide units are mounted respectively and securely to two opposite transverse ends of the elongated base plate for guiding movement of the sliding-plate assembly on the elongated base plate in a direction toward the plate cylinder.

The driving units are mounted respectively on the second guide units for moving the sliding-plate assembly relative to the elongated base plate so as to push the erasing member against the printing plate of the plate cylinder.

The sliding-plate assembly of the mounting unit includes a sliding plate superimposed on the elongated base plate so as to be moved relative to the elongated base plate, an eraser-holding plate which is disposed on the sliding plate and which has a mounting section formed on one edge adjacent to the plate cylinder for receiving the erasing member, and at least one connecting unit interconnecting the sliding plate and the eraser-holding plate. The elongated base plate has a notch formed in a longitudinal edge thereof, and at least one guiding slot formed in the top surface thereof. The connecting unit includes a connecting plate which has an upper section that is connected to the eraser-holding plate, a middle section that is connected releasably to the sliding plate, and a lower section that is aligned with the notch of the base plate so as to be received into the notch when the sliding-plate assembly moves toward the plate cylinder. The sliding-plate assembly further includes at least one guide roller unit which is mounted on a bottom surface of the sliding plate and which extends into the guiding slot of the elongated base body so as to guide sliding of the sliding plate on the elongated base plate toward the plate cylinder.

Each of the second guide units includes a guide body having a lower portion fixed to a respective one of the opposite transverse ends of the elongated base plate, an intermediate portion formed with a guiding groove for guiding movement of one edge of the sliding plate toward the plate cylinder, and a top face to mount a respective one of the driving units. The top face of each of the guide bodies is formed with a guiding hole communicated with a respective one of the guiding grooves. The guiding holes extend in a direction perpendicular to the axial direction of the plate cylinder.

Each of the driving units includes a driving member with a piston rod, a holding member secured to the top face of the guiding body for holding the driving member, a coupling body which is connected to the piston rod and which extends into the guiding groove via the guiding hole, and a slidable rod which is disposed movably within the guiding groove and which is connected to the coupling body. The coupling bodies are slidable along the guiding holes through movement of the piston rods of the driving members so as to move the slidable rods along the guiding grooves toward the plate cylinder. The slidable rods are connected securely and respectively to opposite edges of the sliding plate and are circular in cross section. Each of the guiding grooves is an open-ended groove which is defined by a curved peripheral surface so as to facilitate smooth sliding movement of the slidable rods along the guiding grooves.

BRIEF DESCRIPTION OF THE DRAWINGS

Other features and advantages of this invention will becomes apparent in the following detailed description of a preferred embodiment of this invention, with reference to the accompanying drawings, in which.

DETAILED DESCRIPTION OF THE PREFERRED EMBODIMENT

Figure 8:
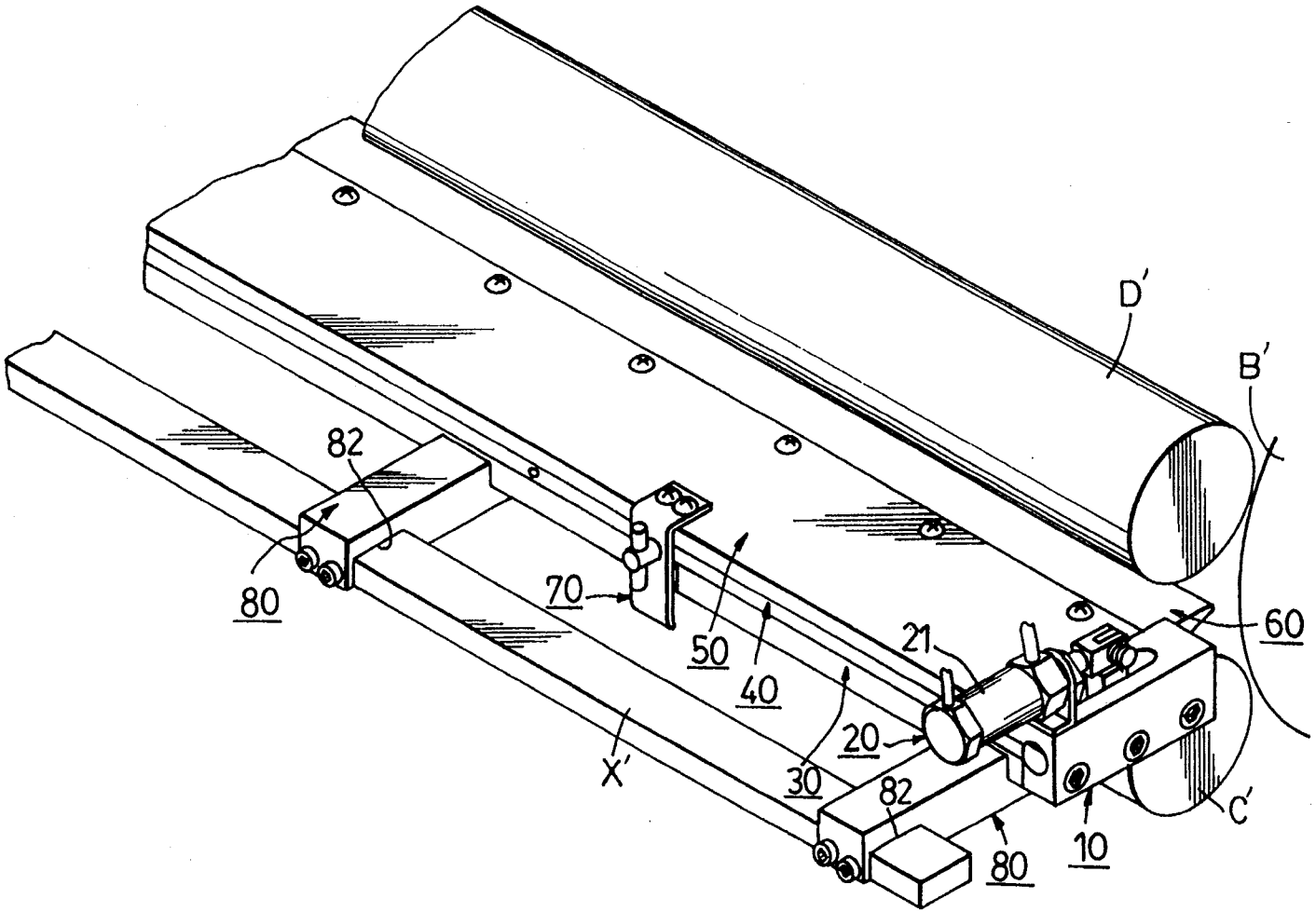
FIG. 8 is a schematic view illustrating how the apparatus of this invention is mounted to the offset printing press adjacent to the plate cylinder of the latter.

Referring to FIG. 8, a preferred embodiment of an apparatus of this present invention, which is used for erasing a plate cylinder (B') of an offset printing press (not shown), includes a first guide unit (X'), a mounting unit, a pair of second guide units 10 (only one is shown) and a pair of driving units 20 (only one is shown). It is noted that only one-half of the apparatus is shown in the drawings.

The plate cylinder (B') of the offset printing press carries a printing plate. The offset printing press further has an inking roller (D') and a moistening roller (C') which are installed in a known manner and which are spaced apart from each other.

The first guide unit (X') is an elongated plate which is mounted securely to the offset printing press apart from the plate cylinder (B') and which extends in an axial direction of the plate cylinder (B').

Figure 1:
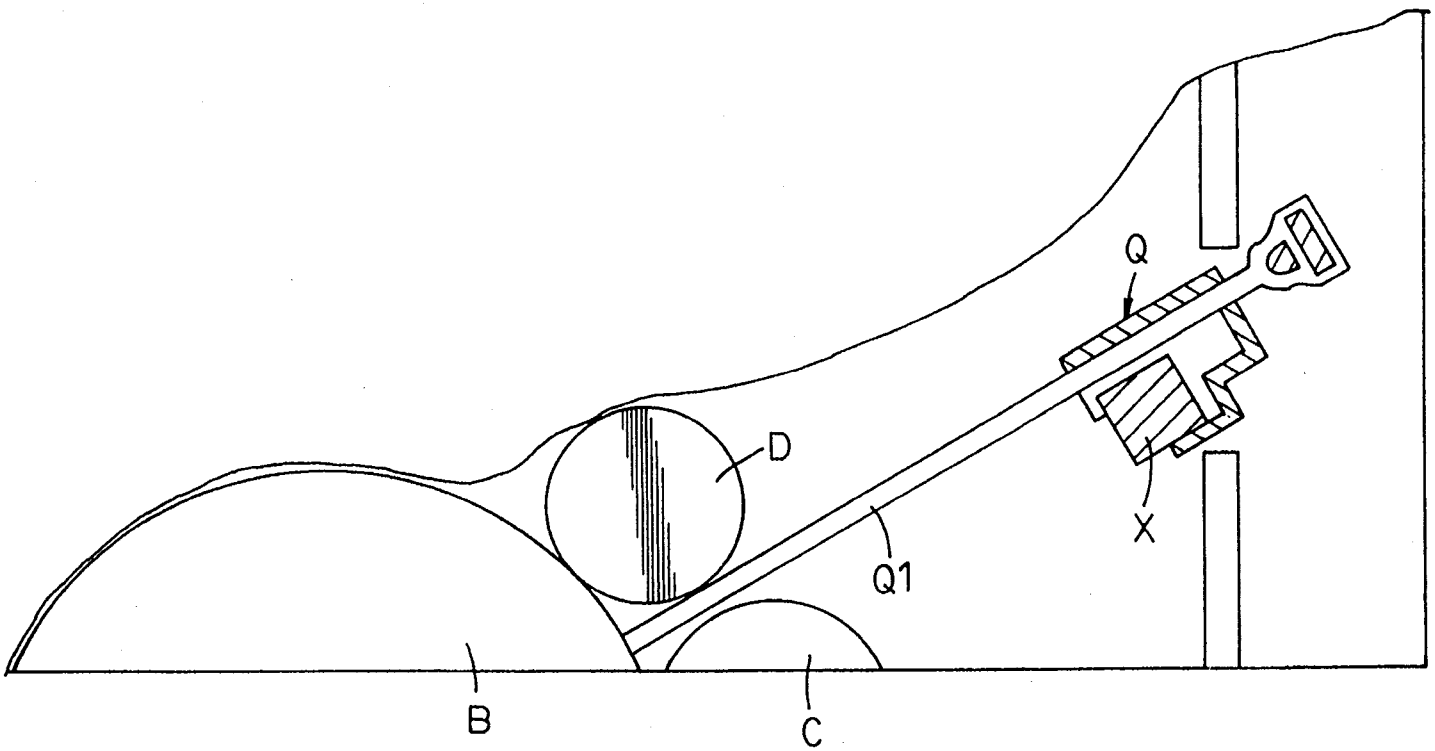
FIG.1 PRIOR ART
FIG. 1 is a schematic view showing a conventional apparatus for erasing a plate cylinder of an offset printing press and which is mounted on the latter.
Figure 2:
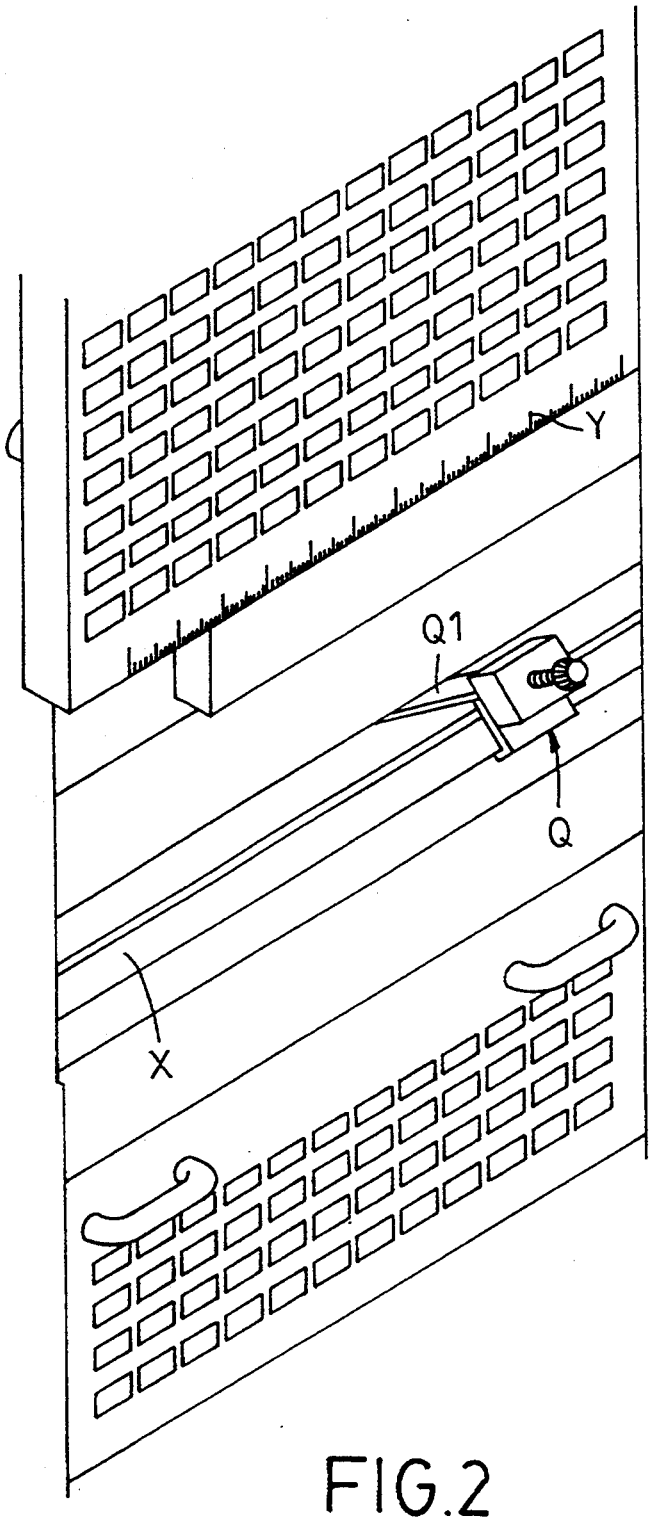
FIG.2 PRIOR ART
FIG. 2 is a perspective view showing a part of the conventional apparatus which is mounted on the offset printing press.
Figure 3:
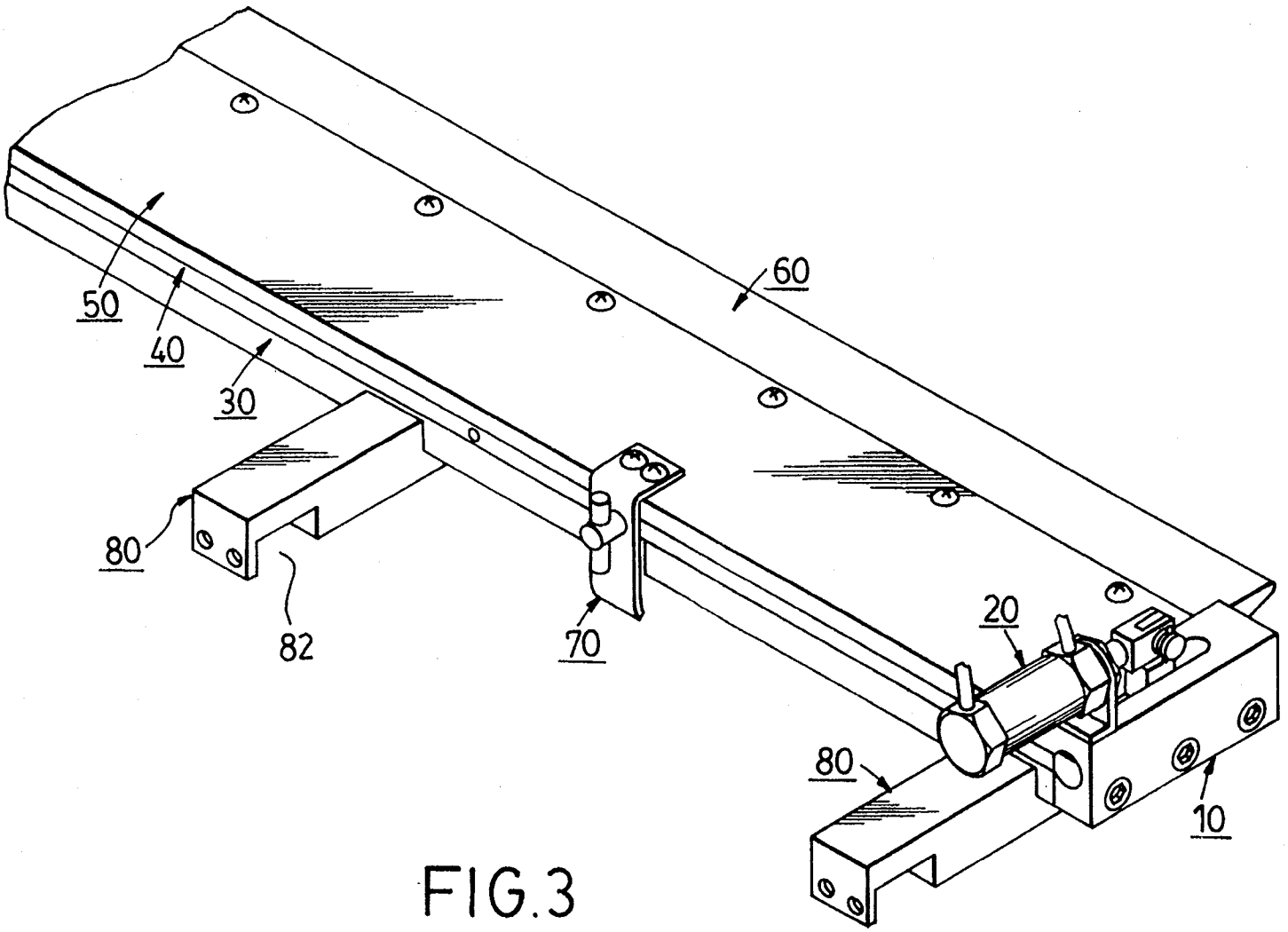
FIG. 3 is a perspective view showing a part of the apparatus for erasing a plate cylinder of an offset printing press according to the preferred embodiment of this invention.
Figure 4:
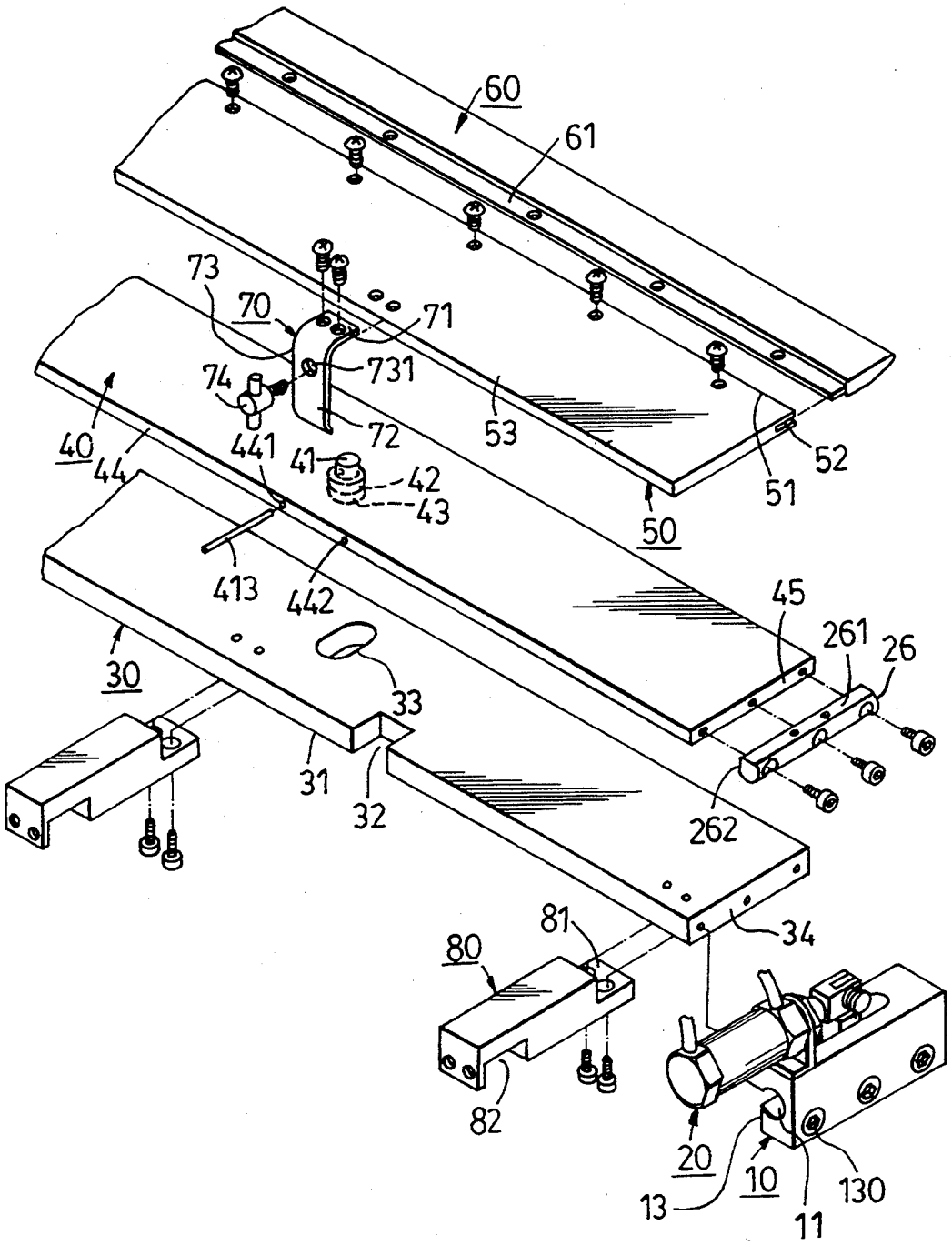
FIG. 4 is an exploded view showing one-half of the apparatus of the preferred embodiment of this invention.

Referring to FIGS. 3 and 4, the mounting unit includes four mounting members 80 (only two are shown) which are spaced apart from one another at a predetermined distance, an elongated base plate 30 and a sliding-plate assembly. Each of the mounting members 80 is an elongated block which has an end portion formed with a shoulder 81 that bears and that is connected threadably to a bottom surface of a longitudinal edge 31 of the elongated base plate 30, and another end portion formed with an accommodation space 82.

The first guide unit (X'), as shown in FIG. 8, extends through the accommodation spaces 82 of the mounting members 80 and is mounted threadably to the latter so as to fix the mounting members 80 thereon. The elongated base plate 30 is fixed on and spans the mounting members 80.

Referring again to FIGS. 4 and 8, the elongated base plate 30 has two notches 32 (only one is shown) formed in the longitudinal edge 31 thereof and spaced apart from each other, and two guiding slots 33 (only one is shown) formed in a top surface thereof and spaced apart from each other.

Figure 6:
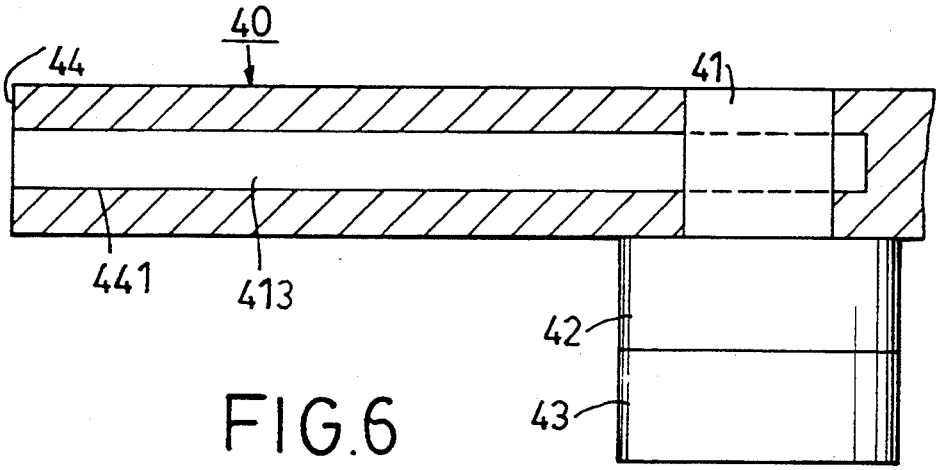
FIG. 6 is a partially sectional view showing a sliding plate of a sliding-plate assembly of the apparatus according to this invention.
Figure 9:
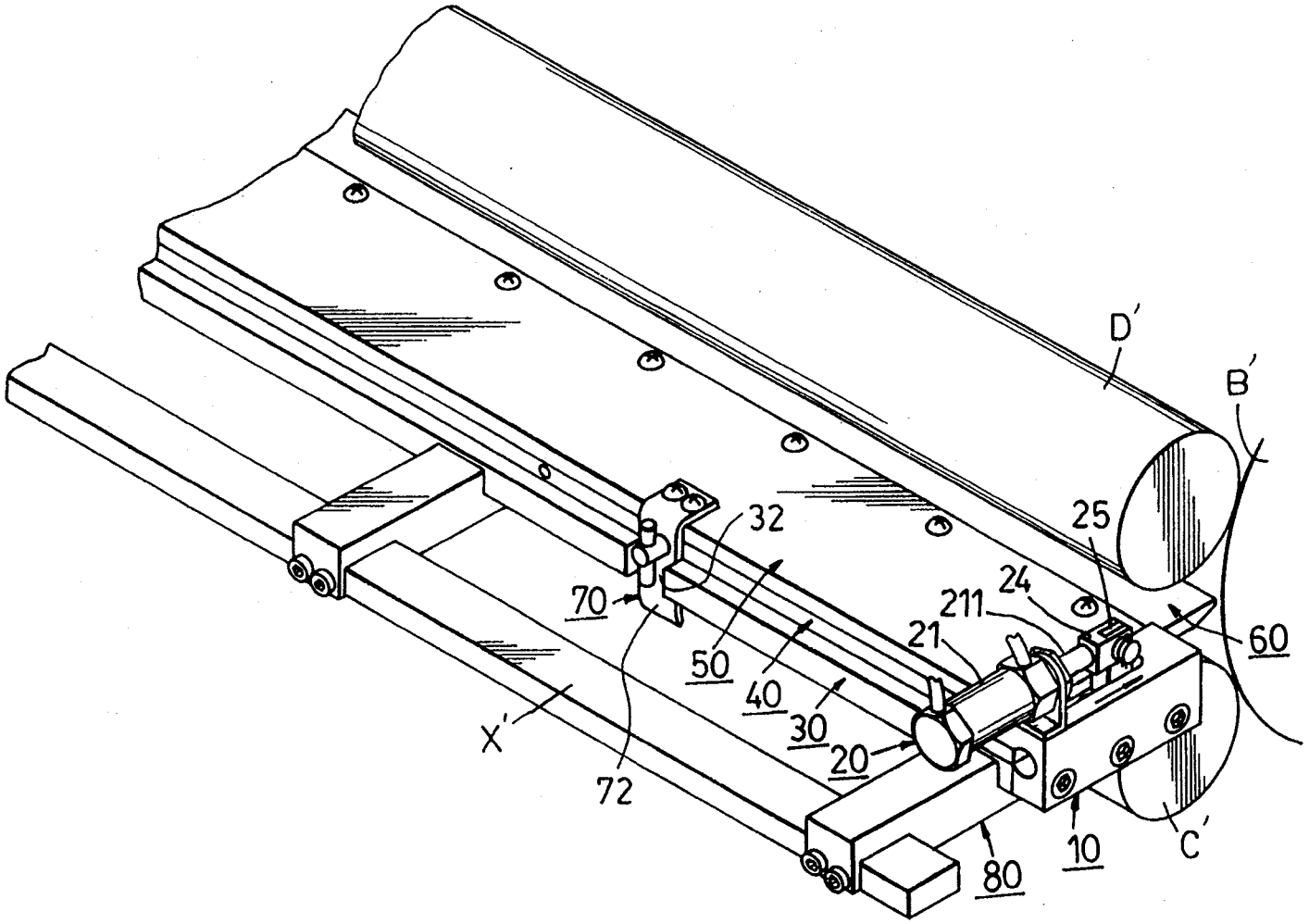
FIG. 9 is a schematic view illustrating how the apparatus of this invention is actuated to erase the plate cylinder of the offset print press.

The sliding-plate assembly includes a sliding plate 40, an eraser-holding plate 50, an erasing member 60, and two connecting units 70 (only one is shown). The sliding plate 40 is superimposed on the elongated base plate 30 for movement relative to the elongated base plate 30, and has two guide roller units (only one is shown) which are mounted on a bottom surface of the sliding plate 40 and which extend into the guiding slots 33 of the elongated base plate 30. Each of the guide roller units includes a shaft 41 which extends downwardly from the sliding plate 40 (see FIG. 6) into a respective one of the guiding slots 33 of the elongated base plate 30, and two overlapping rotary wheels 42, 43 which are mounted on a distal end of the shaft 41 at central portions thereof. The rotary wheels 42, 43 are rotatable in the corresponding one of the guiding slots 33 so as to facilitate movement of the guide roller units within the guiding slots 33 of the elongated base plate 30. Accordingly, the guide roller units can guide sliding of the sliding plate 40 on the elongated base plate 30 toward the plate cylinder (B'). The sliding plate 40 has two blind holes 441 (only one is shown) and two threaded holes 442 (only one is shown) formed in a longitudinal edge 44 thereof. Referring to FIGS. 4 and 6, each of the blind holes 441 extends from the longitudinal edge 44 into an upper portion of a respective one of the shafts 41. A positioning rod 413 extends into the blind hole 441 and through the upper portion of the shaft 41 so as to fix the shaft 41 on the sliding plate 40. Referring again to FIGS. 4 and 8, the eraser-holding plate 50 is disposed on the sliding plate 40 and has a mounting section. Preferably, the mounting section is an elongated groove 52 that is formed in a longitudinal edge 51 of the eraser-holding plate 50. The erasing member 60 has an engageable portion 61 formed on a longitudinal edge thereof and engaged with the elongated groove 52 so as to be connected threadably to the mounting section of the eraser-holding plate 50. Each of the connecting units 70 includes a connecting plate which has an upper section 71 connected threadably to another longitudinal edge 53 of the eraser-holding plate 50, a middle section 73 connected releasably to the sliding plate 40 by means of a lock bolt 74 which extends through a hole 731 of the connecting plate into the corresponding threaded hole 442 of the sliding plate 40, and a lower section 72 aligned with the corresponding notch 32 of the elongated base plate 30 so as to be received into the notch 32 when the sliding-plate assembly moves toward the plate cylinder (B'), as shown in FIG. 9.

It is noted that the longitudinal length of the erasing member 60 is almost equal to the axial length of the plate cylinder (B'). Accordingly, the erasing member 60 can erase impurities on the printing plate of the plate cylinder (B') entirely at one time without the needs for using a sensor to detect the presence of impurities on the printing plate of the plate cylinder (B') and for moving manually the apparatus along the first guide unit (X') to align the erasing member 60 with the detected impurities, as required in the first and second operating steps of the conventional apparatus.

Figure 10:
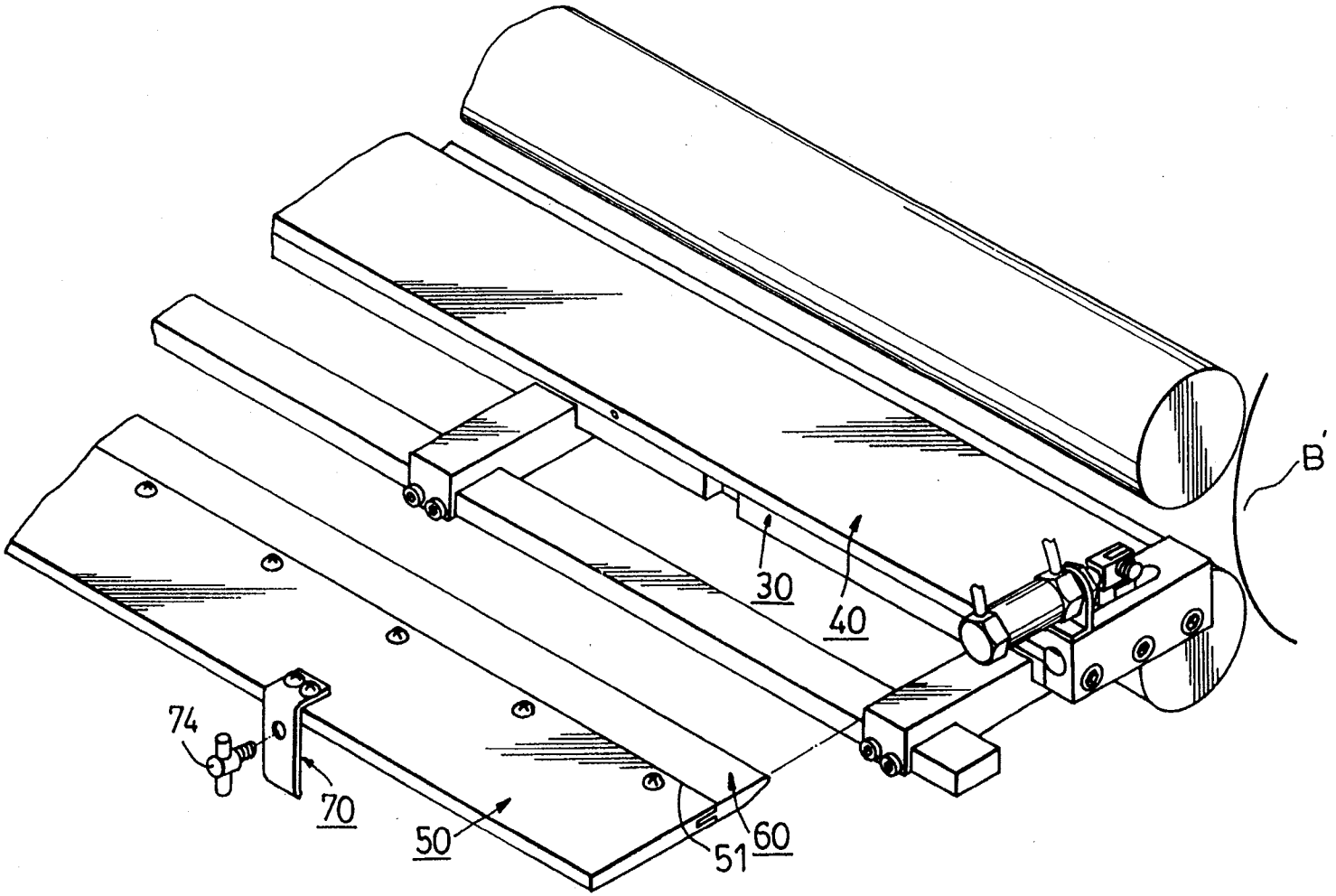
FIG. 10 is a schematic view illustrating how an erasing member of the sliding-plate assembly is removed from the apparatus of this invention for cleaning or replacement purposes.

Referring to FIG. 10, when the lock bolt 74 is unlocked, the assembly of the eraser-holding plate 50 and the erasing member 60, as well as the connecting units 70, can be removed from the sliding plate 40 so as to facilitate cleaning or replacement of the erasing member 60.

Figure 5:
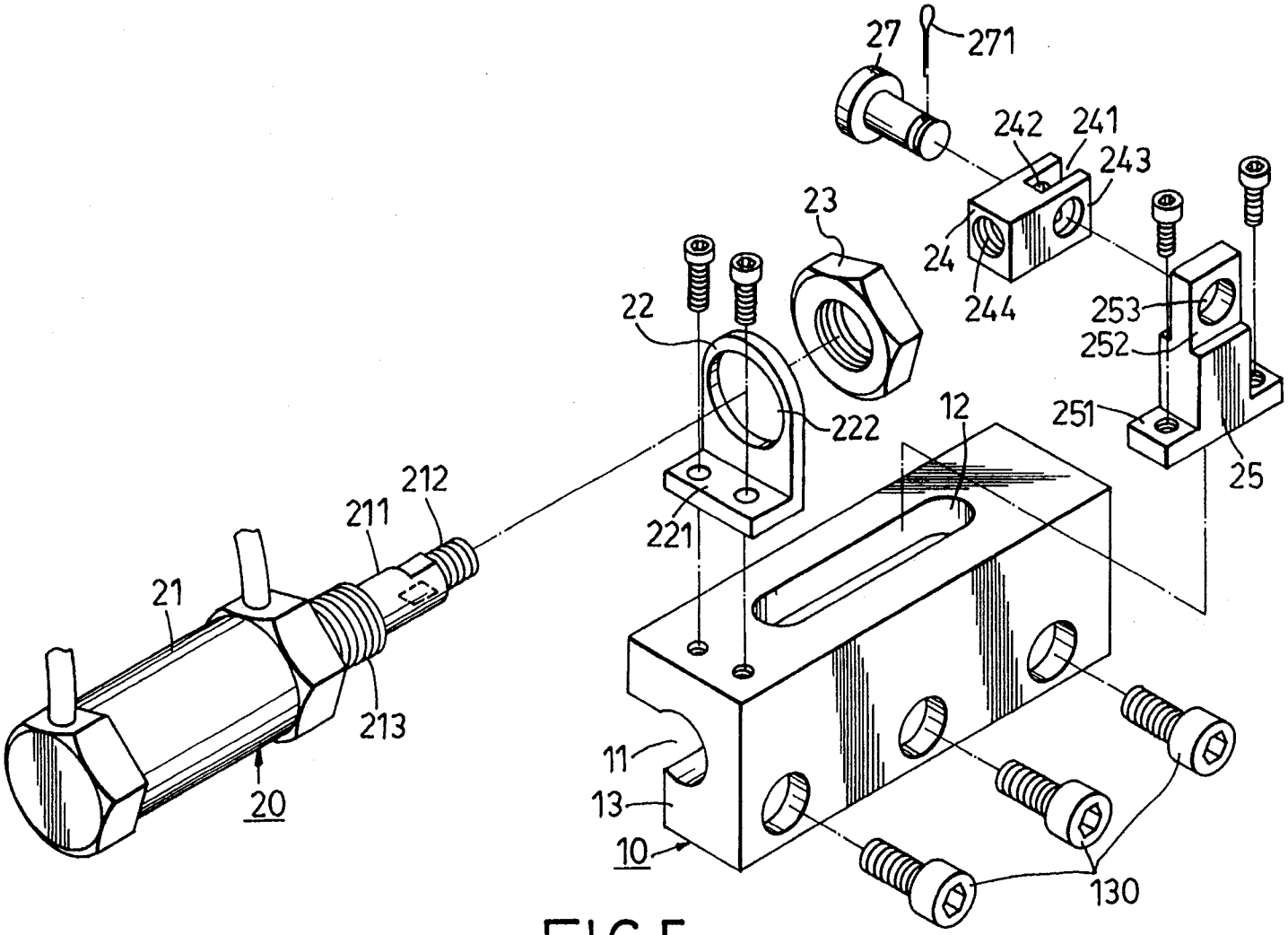
FIG. 5 is an exploded view showing a driving unit and a second guide unit of the apparatus according to this invention.
Figure 7:
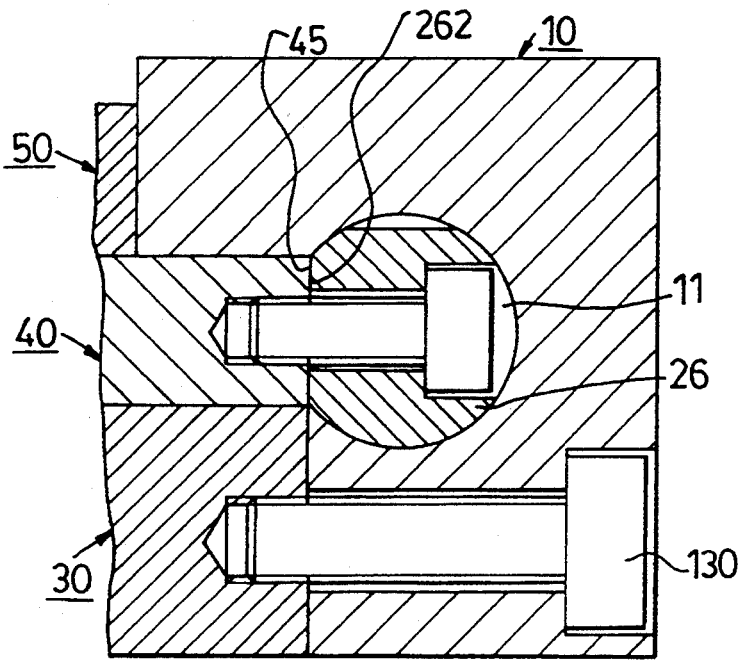
FIG. 7 is a sectional view illustrating the combination of the sliding-plate assembly and the second guide unit, as well as an elongated base plate of the apparatus of this invention.

Referring to FIGS. 4 and 5, each of the second guide units 10 includes a guide block which has a lower portion 13 connected threadably to one of two opposite transverse ends 34 of the elongated base plate 30 by means of several bolts 130 (see FIG. 7), an intermediate portion formed with a guiding groove 11 for guiding movement of the sliding plate 40 toward the plate cylinder (B') (see FIG. 9), and a top face for mounting one of the driving units 20 thereon. The top face of the guide block is formed with a guiding hole 12 which is communicated with the guiding groove 11 and which extends in a direction perpendicular to the axial direction of the plate cylinder (B') (see FIG. 8). Each of the guiding grooves 11 is an open-ended groove which is defined by a curved peripheral surface.

Each of the driving units 20, as shown in FIG. 5, includes a driving member 21 which can be a pneumatic cylinder or a hydraulic cylinder. The driving member 21 has a first outwardly threaded portion 213, and a piston rod 211 which extends telescopically from a central portion of the first outwardly threaded portion 213 toward the plate cylinder (B') (see FIG. 9) and which has a diameter-decreased distal end portion formed with a second outwardly threaded portion 212. A holding member 22 has a lower portion 221 mounted threadably on the top face of a corresponding one of the guide blocks of the second guide units 10, and an accommodation hole 222 which allows the first outwardly threaded portion 213 and the piston rod 221 of the driving member 21 to extend therethrough. A nut 23 is mounted threadably on the first outwardly threaded portion 213 of the driving member 21 for holding the driving member 21 on the holding member 22. A transmission member 24 has an end portion formed with an inwardly threaded hole 244 which engages the second outwardly threaded portion 212 of the piston rod 211, and another end portion formed with two spaced plates which confine an accommodation space 241 therebetween and which have aligned holes 242, 243 formed therethrough. A coupling body 25 has an upper portion 252 which is disposed within the accommodation space 241 of the transmission member 24 and which has a hole 253 aligned with the holes 242, 243 of the transmission member 24, and a lower portion 251 which extends into the guiding groove 11 of the guide block of the second guide unit 10 via the guiding hole 12. A retaining rod 27 extends through the holes 242, 243, 253 of the transmission member 24 and the coupling body 25 so as to retain the transmission member 24 and the coupling body 25 together by means of a pin 271 which extends diametrically through a distal end portion of the retaining rod 27. A slidable rod 26, as shown in FIG. 4, is disposed movably within the guiding groove 11. The slidable rod 26 is connected threadably to the lower portion 251 of the coupling body 25 (see FIG. 5) at a top surface 261 thereof and is connected threadably to one of two opposite transverse edges 45 of the sliding plate 40 at a side surface 262 thereof (see FIG. 7).

It is noted that the slidable rod 26 has a circular cross section (see FIG. 7) so that, when disposed within the guiding groove 11 that is defined by a curved peripheral surface, the slidable rod 26 can slide smoothly along the guiding groove 11.

Referring again to FIG. 9, when the driving member 21 is actuated to push the combination of the transmission member 24 and the coupling body 25 toward the plate cylinder (B') through movement of the piston rod 211, the sliding plate 40 of the sliding-plate assembly can be moved toward the plate cylinder (B') relative to the elongated base plate 30, by virtue of the sliding of the slidable rod 26 along the guiding groove 11, so as to push the erasing member 60 against the printing plate of the plate cylinder (B'). Accordingly, the erasing member 60 can erase the whole printing plate of the plate cylinder (B') at one time without the need to depress manually the erasing member 60 against the printing plate of the plate cylinder (B'), as required in the third operating step of the conventional apparatus.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. An apparatus for erasing a plate cylinder of an offset printing press, said plate cylinder carrying a printing plate, said apparatus comprising a first guide unit which is mounted securely on said offset printing press apart from said plate cylinder and which extends in an axial direction of said plate cylinder, a mounting unit mounted on said first guide unit, and an erasing member mounted on said mounting unit for erasing impurities on said printing plate of said plate cylinder, wherein:

said mounting unit includes at least two spaced mounting members mounted on said first guide unit, an elongated base plate which spans and which is fixed to said mounting members, and a sliding-plate assembly mounted longitudinally and movably on a top surface of said elongated base plate for holding said erasing member;

a pair of second guide units are mounted respectively and securely to two opposite transverse ends of said elongated base plate for guiding movement of said sliding-plate assembly on said elongated base plate in a direction toward said plate cylinder; and a pair of driving units are mounted respectively on said second guide units for moving said sliding-plate assembly relative to said elongated base plate so as to push said erasing member against said printing plate of said plate cylinder.

2. An apparatus as claimed in claim 1, wherein said sliding-plate assembly includes a sliding plate superimposed on said elongated base plate so as to be moved relative to said elongated base plate, an eraser-holding plate which is disposed on said sliding plate and which has a mounting section formed on one edge adjacent to said plate cylinder for receiving said erasing member, and at least one connecting unit interconnecting said sliding plate and said eraser-holding plate.

3. An apparatus as claimed in claim 2, wherein said elongated base plate has a notch formed in a longitudinal edge thereof, said connecting unit including a connecting plate which has an upper section connected to said eraser-holding plate, a middle section connected releasably to said sliding plate, and a lower section aligned with said notch of said base plate so as to be received in said notch when said sliding-plate assembly moves toward said plate cylinder.

4. An apparatus as claimed in claim 2, wherein each of said second guide units includes a guide body having a lower portion fixed to a respective one of said opposite transverse ends of said elongated base plate, an intermediate portion formed with a guiding groove for guiding movement of one edge of said sliding plate toward said plate cylinder, and a top face for mounting a respective one of said driving units thereon.

5. An apparatus as claimed in claim 4, wherein said top face of said guide body of each of said second guide units is formed with a guiding hole communicated with said guiding groove, said guiding hole extending in a direction perpendicular to said axial direction of said plate cylinder.

6. An apparatus as claimed in claim 5, wherein each of said driving units includes a driving member with a piston rod, a holding member secured to said top face of the respective said guide body for holding said driving member, a coupling body which is connected to said piston rod and which extends into said guiding groove via said guiding hole, and a slidable rod which is disposed movably within said guiding groove and which is connected to said coupling body, said coupling bodies of said driving units being slidable along said guiding holes of said second guide units through movement of said piston rods of said driving members so as to move said slidable rods of said driving units respectively along said guiding grooves of said second guide units toward said plate cylinder, said slidable rod of each of said driving units being connected securely to said one edge of said sliding plate.

7. An apparatus as claimed in claim 6, wherein said elongated base plate has at least one guiding slot formed in said top surface thereof, said sliding-plate assembly further including at least one guide roller unit which is mounted on a bottom surface of said sliding plate and which extends into said guiding slot of said elongated base plate so as to guide sliding of said sliding plate on said elongated base plate toward said plate cylinder.

8. An apparatus as claimed in claim 7, wherein said guide roller unit of said sliding-plate assembly includes a shaft extending downwardly from said bottom surface of said sliding plate into said guiding slot of said elongated base plate, and a rotary wheel mounted to a distal end of said shaft at a central portion thereof, said rotary wheel being rotatable in said guiding slot so as to facilitate movement of said guiding roller unit within said guiding slot of said elongated base plate.

9. An apparatus as claimed in claim 6, wherein said slidable rod of each of said driving units has a circular cross section, said guiding groove of each of said second guide units being an open-ended groove which is defined by a curved peripheral surface so as to facilitate smooth sliding of said slidable rod along said guiding groove.

10. An apparatus as claimed in claim 6, wherein said driving member is a pneumatic cylinder.

11. An apparatus as claimed in claim 6, wherein said driving member is a hydraulic cylinder.

* * * * *